United States Patent [19]

Ramer

[11] Patent Number: 4,467,442

[45] Date of Patent: Aug. 21, 1984

[54] MICROWAVE QUARTER-SQUARE MULTIPLIER

[75] Inventor: Jon Ramer, Orlando, Fla.

[73] Assignee: The United States of America as represented by the Secretary of the Army, Washington, D.C.

[21] Appl. No.: 325,695

[22] Filed: Nov. 30, 1981

[51] Int. Cl.[3] ..... G06G 7/164

[52] U.S. Cl. ..... 364/843; 307/490; 307/529; 328/160; 328/144

[58] Field of Search ..... 364/843; 307/490, 529; 328/160, 144

[56] References Cited

U.S. PATENT DOCUMENTS

| | | | |
|---|---|---|---|
| 2,959,350 | 11/1960 | Trueblood | 364/483 |
| 2,967,954 | 1/1961 | Hobrough | 328/160 |
| 3,000,565 | 9/1961 | Wilkinson | 364/483 |
| 3,253,135 | 5/1966 | Collings et al. | 364/483 |
| 3,348,120 | 10/1967 | Geyger | 328/144 |
| 3,413,456 | 11/1968 | Sutton | 364/483 |
| 3,780,273 | 12/1973 | Turrell | 364/483 |
| 4,123,703 | 10/1978 | Robinson | 324/58.5 B |
| 4,285,060 | 8/1981 | Cobb et al. | 455/304 |

OTHER PUBLICATIONS

*The Radio Amateur's Handbook*, Myers, R. ed., 1973, pp. 580–582.

*Primary Examiner*—Joseph F. Ruggiero
*Assistant Examiner*—John R. Lastova
*Attorney, Agent, or Firm*—Robert P. Gibson; Anthony T. Lane; Freddie M. Bush

[57] ABSTRACT

The microwave quarter-square multiplier uses square law devices in combination to obtain vector multiplication at microwave frequencies. A sum and difference hybrid provides sum and difference output voltages from two separate inputs. Identical square law devices respond to the sum and difference outputs to provide an algebraic summation as the output difference voltage.

3 Claims, 2 Drawing Figures

MICROWAVE QUARTER-SQUARE MULTIPLIER

DEDICATORY CLAUSE

The invention described herein was made in the course of or under a contract or subcontract thereunder with the Government and may be manufactured, used, and licensed by or for the Government for governmental purposes without the payment to me of any royalties thereon.

BACKGROUND OF THE INVENTION

Quarter-square multipliers have been implemented (analog computation) with piece-wise linear approximation using diodes and resistors. This technique suffers from parasitic capacitive reactance at 50 megahertz or higher frequencies, and is a fairly high voltage, high impedence technique (plus or minus 10 volts, 1K ohm), which is not well suited to microwave use. Similarly, the integrated circuit multiplier is not well suited for microwave use. Most double grid tubes, double base transistors, and double gate field effect transistors can be biased for product detection. However, the dynamic range available is small. One difficulty lies in obtaining satisfactory response down to d.c. (CW carrier). Other difficulties include the limit in carrier frequency to several hundred megahertz, and the supply of power and bias voltage, all of which make this a less desirable approach to providing a microwave quarter-square multiplier. Transconductance multipliers and linear piece-wise approximation devices are limited by interelectrode reactances to frequencies below 100 megahertz.

SUMMARY OF THE INVENTION

The microwave quarter-square multiplier is a circuit that electronically provides vector multiplication of desirable input microwave signals. The vector multiplication is accomplished using a passive network that provides sum and difference voltages from two input voltages. Square law devices combine the signals and summation occurs at the output as the output difference voltage. The circuit takes advantage of providing multiplication using the mathematical equation expressing the product of two variables as being equal to $\frac{1}{4}$ of the difference between the squares of the sum and the difference of the variables.

DESCRIPTION OF THE PREFERRED EMBODIMENT

Figure 1:
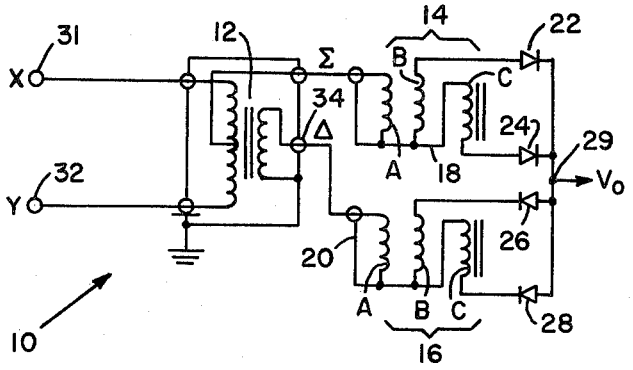
FIG. 1 is a schematic diagram of a preferred embodiment of the microwave quarter-square multiplier.

Referring now to FIG. 1 of the drawings wherein a preferred embodiment of the multiplier is shown, multiplier 10 comprises a passive network input stage 12, a first trifilar toroid 14, a second trifilar toroid 16, and an array of diodes coupled to the respective toroids outputs to provide summation as a direct current output voltage. Passive network 12 is a sum and difference hybrid. Each trifilar toroid comprises a first winding or coil A coupled to the hybrid 12 and having a common connection to remaining windings, coils B and C. Coils B and C are disposed in opposition so that regardless of the polarity of the signal coupled to coil A an output will be received from one or the other diodes connected to coils B and C. Thus, for example, with coil 14A having a positive input and the common lead 18 being negative, a positive output is coupled from coil B to diode 22 and a negative output is coupled from coil C to diode 24. Similarly for toroid 16, with common lead 20 connecting the coils, a positive input develops a positive output from coil 16B to diode 26 and a negative output from coil 16C to diode 28. Thus when the input voltages and currents are reversed the opposite case is true and one diode with each toroid will conduct to provide an output.

As shown diodes 22 and 24 have the cathodes coupled in common with the anodes of diodes 26 and 28, all of these being coupled to provide a direct current output voltage $V_0$. With the analog voltage X impressed on terminal 31 of hybrid 12 and an analog voltage Y impressed on terminal 32 of hybrid 12, the two voltages are differentially coupled to output 34 of the hybrid for providing a difference output signal (X−Y) which is supplied to coil 16. The two inputs X and Y, after passing through the primary of the hybrid are supplied as a sum (X+Y) to coil 14A. Thus instantaneous voltages X+Y and Y−Y are readily obtained from sum and difference hybrid 12. By using matched identical square law devices (diodes) with reverse polarity on one pair of them, algebraic summation is done directly at the summing point 29. The output of the circuit may be indicated in equation form as:

$$XY=\tfrac{1}{4}[(X+Y)^2-(X-Y)^2]. \quad (1)$$

Figure 2:
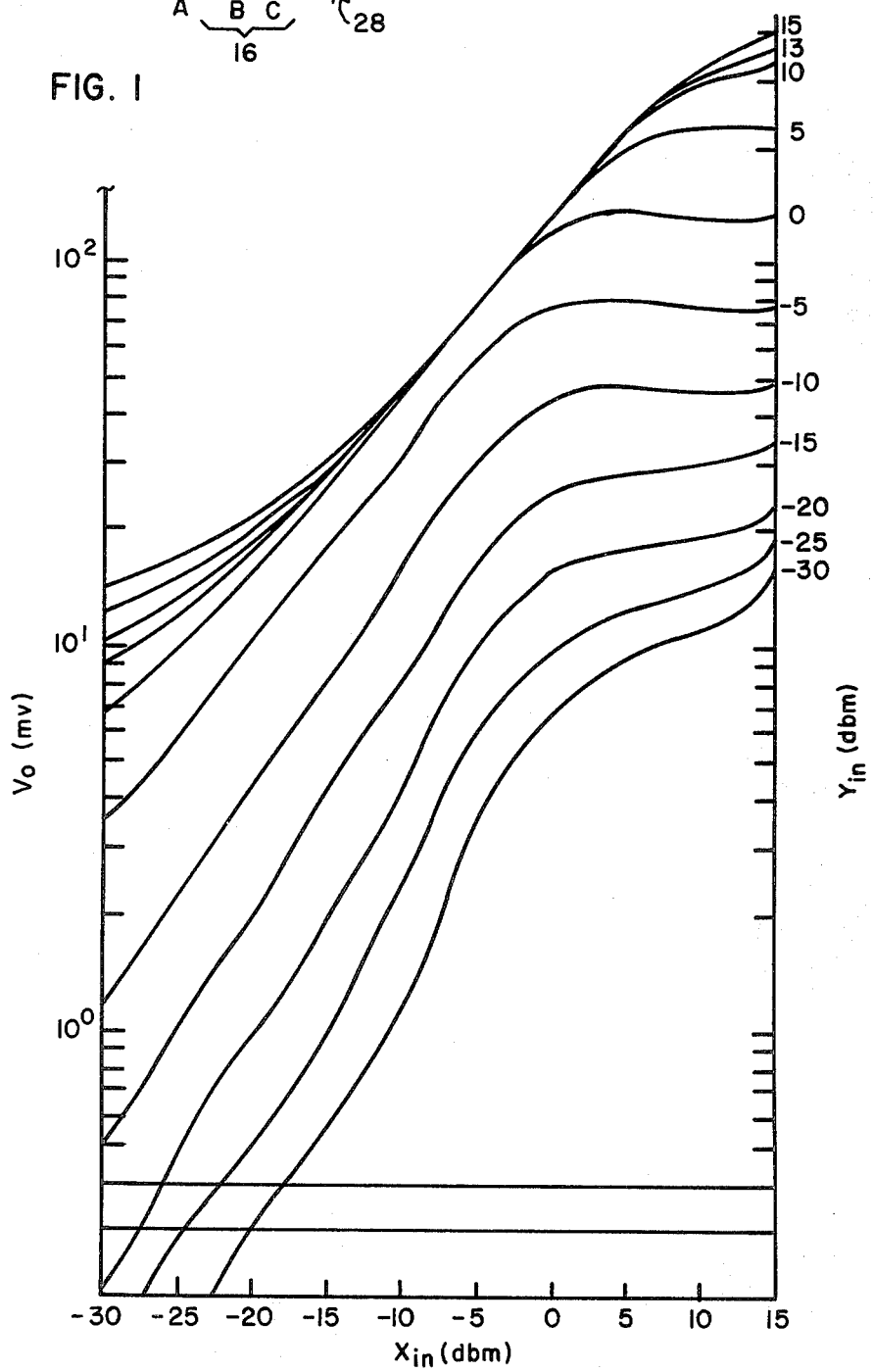
FIG. 2 is a graph showing the output voltage from the device of FIG. 1 in response to the two input signal voltages.

FIG. 2 is a graph of measurements of the direct current output $V_0$ in millivolts using two input carriers X and Y, each carrier being co-phase at 30 megahertz. The two signals are co-phase or in phase to make the cosine of their relative phase angle equal 1. X and Y inputs are shown in dBm with X on the horizontal scale and Y as the vertical scale. It is apparent from the curves that when either X input or Y input exceeds −5 dBm the product operation is no longer obtained for all inputs. However, as shown by the linear even-space data below −5 dBm input the vector product operation does substantially occur. Thus the maximum power level for near product operation is seen to be about −5 dBm. Some deviation is apparent since perfect square law was not obtained with the diodes. Thus while all diodes may not be perfect square law devices they are accurate for microwave signals at low power levels.

For signal processing circuits such as modulators, demodulators and phase detectors the microwave quarter-square multiplier will function as a product detector for two variable input signals. The 30 megahertz frequency example is not a limiting feature and the microwave frequency of operation is limited only by the frequency limitation of the particular passive components used, such as hybrid 12.

Although a particular embodiment of this invention has been illustrated, it is apparent that various modifications of the invention may be made by those skilled in the art without departing from the scope and spirit of the foregoing disclosure. Accordingly, the scope of the invention should be limited only by the claims appended hereto.

I claim:

1. A microwave quarter-square multiplier comprising: a sum and difference hybrid having first and second inputs for receiving first and second analog input signals, and having first and second outputs for providing sum and difference outputs respectively; a first means responsive to the sum output of said hybrid for providing multiplication and rectification of signals coupled to said first means for providing a direct current output; and a second means responsive to the difference output of said hybrid for providing multiplication and rectification of signals coupled to said second means for providing a direct current output, said direct current outputs being coupled to a common point for providing an output indicative of the multiplication of said first and second analog input signals; and wherein said first and second means are each comprised of three coil windings on a common core, the first winding being disposed to receive input signals from said hybrid, the second and third winding being coupled in series and in opposition for providing an analog output from each of said windings, and each of said first and second means further comprising first and second matched diodes, said first diode being coupled to the output of said second winding and said second diode being coupled to the output of said third winding for providing a direct current output.

2. A microwave quarter-square multiplier as set forth in claim 1 wherein said first and second means are trifilar toroids, all of said diodes are matched, the diodes of said first means are polarized in opposition to the diodes of said second means, and the outputs of said diodes are in common for providing a summed output indicative of vector multiplication of said first and second analog inputs.

3. A microwave quarter-square multiplier as set forth in claim 2 wherein the diodes of said first means are cathode connected directly to the anodes of the diodes of said second means for providing said summed output.

* * * * *